US007293516B2

(12) United States Patent
Bailey et al.

(10) Patent No.: US 7,293,516 B2
(45) Date of Patent: Nov. 13, 2007

(54) APPARATUS FOR RECONFIGURATION OF A VARIABLE-DRAFT VESSEL

(75) Inventors: Stephen L. Bailey, Los Gatos, CA (US); Lewis D. Madden, Morgan Hill, CA (US); Robert G. Bice, Cupertino, CA (US); Yong Lu, San Leandro, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/278,026

(22) Filed: Mar. 30, 2006

(65) Prior Publication Data

US 2007/0039533 A1 Feb. 22, 2007

Related U.S. Application Data

(60) Provisional application No. 60/710,171, filed on Aug. 22, 2005.

(51) Int. Cl.
*B63B 1/14* (2006.01)

(52) U.S. Cl. ..... 114/61.14; 114/61.15

(58) Field of Classification Search ..... 114/61.1, 114/61.12, 61.14, 61.15, 123, 284, 264, 265; 405/203, 208

See application file for complete search history.

(56) References Cited

U.S. PATENT DOCUMENTS

| | | | | |
|---|---|---|---|---|
| 1,397,405 | A * | 11/1921 | Dedik | 114/123 |
| 2,589,146 | A * | 3/1952 | Samuelson | 405/208 |
| 3,099,912 | A * | 8/1963 | Wolff | 405/207 |
| 3,294,051 | A * | 12/1966 | Leonide | 114/265 |
| 3,442,239 | A * | 5/1969 | Wilson | 114/122 |
| 3,983,828 | A * | 10/1976 | Stram | 114/265 |
| 6,877,450 | B2 | 4/2005 | Schmidt et al. | |

FOREIGN PATENT DOCUMENTS

| | | |
|---|---|---|
| EP | 1 123 862 A1 | 8/2001 |
| FR | 2 620 677 A1 | 3/1989 |
| WO | 2006/037663 A1 | 4/2006 |

OTHER PUBLICATIONS

International Search Report and Written Opinion of the International Searching Authority, International Application No. PCT/US2006/032424, issued Feb. 20, 2007.

* cited by examiner

*Primary Examiner*—Sherman Basinger
(74) *Attorney, Agent, or Firm*—DeMont & Breyer LLC

(57) ABSTRACT

A vertical translation mechanism for reconfiguring the hull form of a reconfigurable vessel having independently movably side hulls and a center hull is disclosed. The vertical translation mechanism includes a hydraulic-force actuator and a nonmetallic bearing. The hydraulic force actuator comprises a rod that is disposed within a hydraulic cylinder. Responsive to changes in hydraulic pressure in the cylinder, the rod is extended or retracted therefrom. Movement of the rod controls the vertical translation of the center hull and its rotational attitude relative to the side hulls.

11 Claims, 3 Drawing Sheets

Figure 2
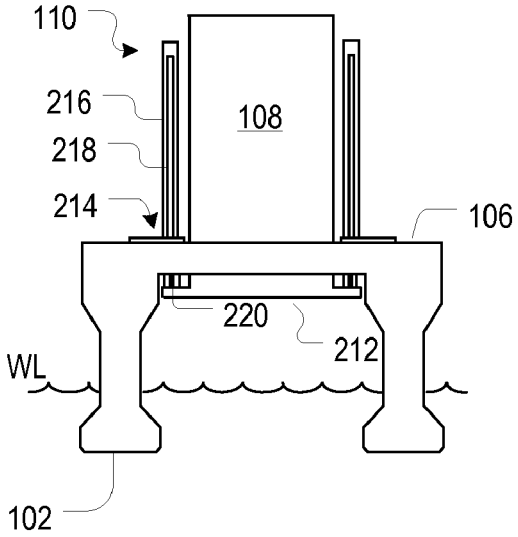
Figure 3
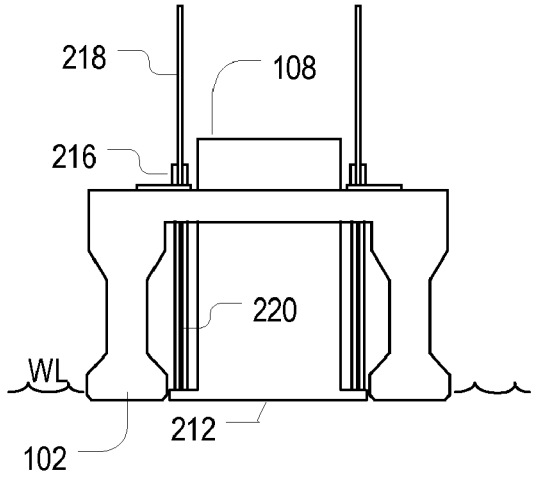
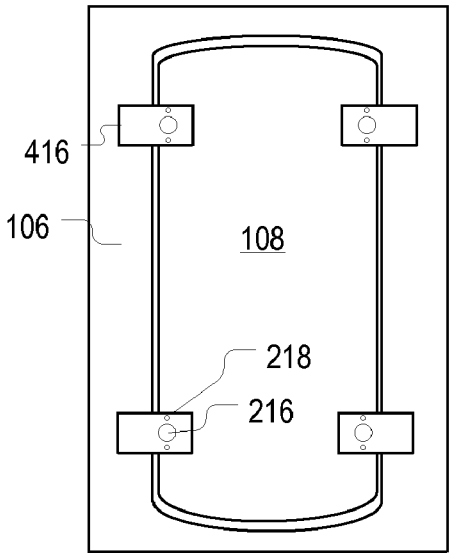
Figure 4

APPARATUS FOR RECONFIGURATION OF A VARIABLE-DRAFT VESSEL

STATEMENT OF RELATED CASES

This case claims priority of U.S. provisional patent application 60/710,171, which was filed on Aug. 22, 2005 and is incorporated by reference herein.

FIELD OF THE INVENTION

The present invention relates to sea-faring vessels. More particularly, the present invention relates to a vessel having a multiple, reconfigurable hulls and a variable draft.

BACKGROUND OF THE INVENTION

Vessel hulls have traditionally been optimized for use in either shallow water or in deep water. For example, to navigate shallow waters, a relatively flat hull is used to maximize displacement and minimize draft. On the other hand, vessels that operate in deep waters frequently have v-shaped hulls that provide deep draft for good seakeeping.

If a vessel is designed for use in shallow waters, its performance in deep waters will be compromised, and vice-versa. This has spurred the development of variable-draft vessels, which are designed to operate well in both shallow and deep waters.

As the name implies, a variable-draft vessel is capable of varying its draft to accommodate changes in water depth or mission requirements. A variable-draft vessel that is disclosed in U.S. Pat. No. 6,877,450 B2 is capable of reconfiguring its hull form to change draft. The vessel includes a flat, center hull that is coupled to two side or outer hulls. The center hull is vertically movable relative to the side hulls to vary draft.

According to the patent, the center hull can be moved above or below the waterline. When the center hull is above the waterline, all buoyancy is provided by the side hulls, and the vessel takes maximum draft. As the center hull dips below the waterline, it contributes to the buoyancy provided by the side hulls. As a consequence, vessel draft is reduced.

SUMMARY OF THE INVENTION

The present invention provides a vertical translation mechanism for reconfiguring the hull form of a reconfigurable, variable-draft vessel. Such a vessel includes a center hull that is flanked by two side hulls. The side hulls typically contain the propulsion mechanism(s) for the vessel. The center hull contains the pilot house, passengers, and vehicle storage.

In accordance with the illustrative embodiment of the present invention, the vertical translation mechanism includes a hydraulic force actuator and a nonmetallic bearing.

The hydraulic force actuator comprises a rod that is disposed within a hydraulic cylinder. Powered by hydraulic force, the rod is extended or retracted from the hydraulic cylinder. Movement of the rod controls the vertical translation of the center hull and its rotational attitude relative to the side hulls.

A nonmetallic bearing, which is (indirectly) coupled at one end to one of the side hulls, slides along a guide post that is anchored to the center hull. The coupling to the side hull provides a structural connection to transmit lateral plane forces to the side hulls.

In the illustrative embodiment, four vertical translation mechanisms are positioned at four corners of the center hull.

BRIEF DESCRIPTION OF THE DRAWINGS

FIG. 2 depicts the vessel of FIG. 1 in a deep-draft mode configuration.

FIG. 3 depicts the vessel of FIG. 1 in a shallow-draft mode configuration.

FIG. 4 depicts a top view of vessel of FIG. 1, showing four vertical translation mechanisms.

DETAILED DESCRIPTION

Figure 1:
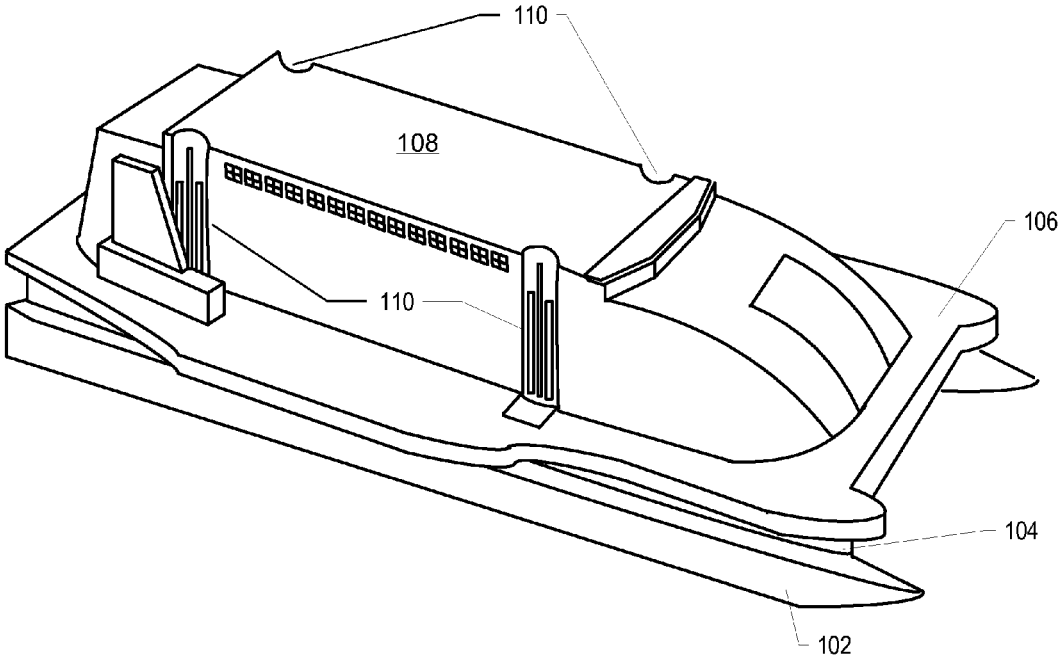
FIG. 1 depicts a reconfigurable, variable-draft vessel in accordance with the illustrative embodiment of the present invention.
Figure 5:
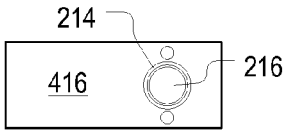
FIG. 5 depicts a top of the vertical translation mechanism.

FIG. 1 depicts re-configurable, variable-draft vessel 100 in accordance with the illustrative embodiment of the present invention. Vessel 100 includes side hulls 102, struts 104, sponson 106, and deck house 108. The deck house, which is also referred to as the center hull, incorporates a pilot house, and, internally, a (lower) deck for vehicles and an (upper) deck for passengers.

Vessel 100 is capable of reconfiguring between deep-draft modes (i.e., catamaran and SWATH) and shallow-draft modes (i.e., barge and wet-deck). To do so, vessel 100 incorporates vertical translation mechanism 110 for moving the center hull 108 relative to side hulls 102. For vessel 100, four vertical translation mechanisms 110 are used, wherein two mechanisms are disposed on each side of center hull 102, one located aft and one located toward the stern.

FIG. 2 depicts vessel 100 in a typical deep-draft mode, wherein bottom 212 of center hull 108 is disposed well above side hulls 102 and above the waterline WL. Since center hull 108 does not typically contact the water when vessel 100 is configured in a deep-draft mode, vessel 100 can travel at higher speeds or with improved sea keeping relative to a shallow-draft mode.

FIG. 3 depicts vessel 100 in a typical shallow-draft mode, wherein the bottom of side hulls 102 and bottom 212 of center hull 108 are substantially co-planar. In the shallow-draft mode configuration that is depicted in FIG. 3, a portion of side hulls 102 and center hull 108 are submerged. In the shallow-draft mode, vessel 100 can approach a shoreline to launch or recover vehicles and personnel (e.g., via ramp 314, etc.).

Referring generally to FIGS. 2-7, each vertical translation mechanism 110 includes bearing 214, guide rod 216, two hydraulic cylinders 218, two rods 220 which are coupled to the hydraulic cylinders, and support plate 416. Vertical translation mechanism 110 is driven by a pump, which is not shown. Those skilled in the art, after reading the present disclosure, will know how to size and operate a pump to power hydraulic vertical translation mechanism 110.

Guide rod 216 and rods 220 are fixed to a surface of center hull 108 near a marginal region thereof. Guide rod 216 is received by support plate 416 and bearing 214. Support plate 416 is attached to sponson 106. Hydraulic cylinders 218 are supported by support plate 416. Since side hulls 102 are attached, via struts 104, to sponson 106, support plate 416 is considered to be "coupled" to the side hulls. Furthermore, center hull 102 is considered to be "movably coupled" to side hulls 102 due to this structural relationship.

Under hydraulic pressure that builds in hydraulic cylinders 218, rods 220 are pushed downward from the hydraulic cylinders. As rods 220 are extended, center hull 108 is pushed downward. Conversely, as rods 220 are retracted in hydraulic cylinders 218, center hull 108 is pulled upward. The guide rod freely slides through bearing 214, which is formed of an elastomeric material.

In this fashion, hydraulic cylinders 218 and rods 220 perform vertical translation of center hull 108. The use of multiple (e.g., four, etc.) vertical translation mechanisms 110 (e.g., see FIG. 4, showing four mechanisms 110, etc.) enables control of the attitude of center hull 108 via differential actuation. This enables, for example, increased draft of side hulls 102 at the stern for increased propulsion efficiency or decreased draft at the bow for beach landings.

Support plate 416, in conjunction with bearing 214 and guide rod 216 resist horizontal plane forces. The bearing, since it is a non-metallic, such as molded rubber or plastic, enables non-binding movement and provides a way to control position and attitude between center hull 108 and sponson 106/side hulls 102. Importantly, non-metallic bearings 214 provide a means for holding center hull 108 while permitting the inevitable structural deflections, which are prevalent in lightweight, aluminum ship structures.

Figure 6:
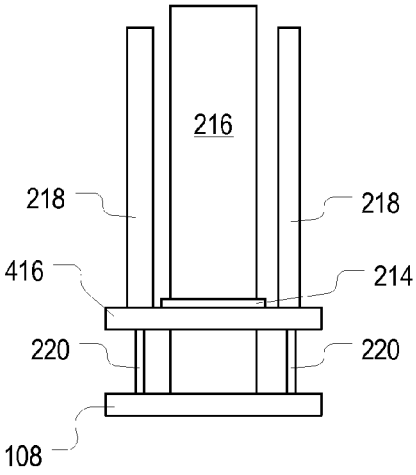
FIG. 6 depicts a side view of the vertical translation mechanism when the vessel is in a deep-draft mode configuration.

Returning now to a discussion of FIG. 2, which depicts vessel 100 in the deep-draft mode, vertical translation mechanism 110 is in a retracted state. That is, rods 220 are substantially retracted within hydraulic cylinders 218. This retracted state is also depicted in FIG. 6. Since rods 220 are fixed to center hull 108, this places the center hull at a maximum vertical position relative to side hulls 102.

Figure 7:
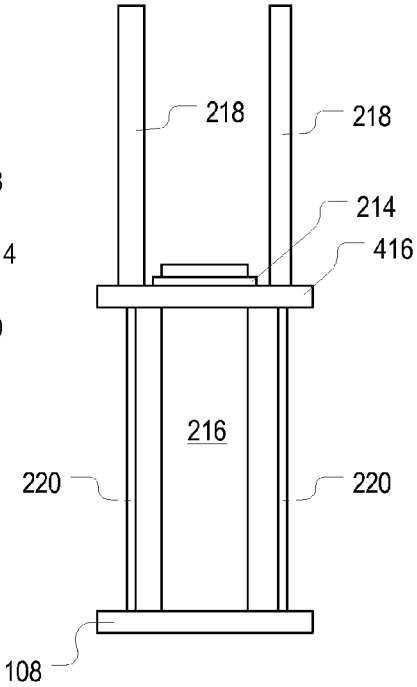
FIG. 7 depicts a side view of the vertical translation mechanism when the vessel is in a shallow-draft mode configuration.

Returning now to a discussion of FIG. 3, which depicts vessel 100 in the shallow-draft mode, vertical translation mechanism 110 is in an extended state. In particular, rods 220 are substantially extended from hydraulic cylinders. This extended state is also depicted in FIG. 7. The extended rods 220 force center hull 108 to a minimum vertical position relative to side hulls 102.

An exemplary design for vertical translation mechanism 110 is provided below. The design is based on using four mechanisms 110 and the following assumptions:

weight of center hull 108, loaded: 149.3 LT weight of center hull 108, unloaded: 99.6 LT displacement of center hull 108 at 3.874 Ft of draft (unloaded condition): 391.7 LT Based on the foregoing assumptions, each mechanism 110 includes two pin-ended cylinders having a twenty-two foot stroke. The hydraulic pressure of the cylinders is 2800 psi operating pressure and 3000 psi max pressure. Each cylinder must be capable of pushing 163,576 pounds and must be capable of lifting 83,608 pounds. The bore of the cylinder is ten inches and the rod is eight inches. Outside diameter of the cylinder is 11.5 inches.

Each cylinder, when filled with hydraulic fluid, weighs 6,596 pounds. The fluid in the cylinder weights 242.3 pounds. To actuate the system in within two minutes will require 133 horsepower.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A variable-draft vessel comprising an apparatus for vertically translating a center hull relative to a side hull, wherein said apparatus comprises:

a guide rod, wherein said guide rod depends from said center hull;

a support plate coupled to said side hull;

an elastomeric bearing that is received by said support plate and which slidingly receives said guide rod;

a hydraulic cylinder, wherein said hydraulic cylinder depends from said support plate; and a rod, wherein said rod is operatively coupled at a first end to said hydraulic cylinder and extends therefrom or retracts therein in response to changes in hydraulic pressure within said cylinder, and wherein said rod is fixedly coupled, at a second end thereof, to said center hull.

2. The variable-draft vessel of claim 1 wherein when said rod is fully extended from said cylinder, said center hull and said side hull are at a maximum vertical distance relative to one another.

3. The variable-draft vessel of claim 1 wherein when said rod is fully retracted within said cylinder, said center hull and said side hull are at a minimum vertical distance relative to one another.

4. The variable-draft vessel of claim 1 further comprising a plurality of said apparatuses, wherein each of said apparatuses are individually actuable, thereby enabling control over the attitude of said center hull.

5. The variable-draft vessel of claim 1 further comprising a plurality of said apparatuses, wherein at least one of said apparatuses is proximal to the stern of said variable-draft vessel and at least one of said apparatuses is proximal to the bow of said vessel.

6. A variable-draft vessel comprising:

a center hull;

two side hulls; and a plurality of vertical translation mechanisms, wherein each of said vertical translation mechanisms movably couples said center hull to one of said two side hulls, and wherein each said vertical translation mechanism comprises:

(a) a hydraulic force actuator, comprising:

1. a quid rod, wherein said guide rod depends from said center hull;
2. a hydraulic cylinder, wherein said hydraulic cylinder depends from a support plate; and
3. a rod, wherein said rod is operatiyely coupled at a first end to said hydraulic cylinder and extends therefrom or retracts therein in response to changes in hydraulic pressure within said cylinder, and wherein said rod is fixedly coupled, at a second end thereof, to said center hull;

(b) a non-metallic bearing, wherein said non-metallic bearing slidingly receives an element of said hydraulic force actuator; and (c) said support plate, wherein said support plate couples to one of said side hulls and receives said non-metallic bearing.

7. The variable-draft vessel of claim 6 wherein at least one of said vertical translation mechanisms is disposed aft and at least one of said vertical translation mechanisms is disposed proximal to the stern of said vessel.

8. The variable-draft vessel of claim 7 wherein said one aft vertical translation mechanism and said one stern vertical translation mechanism are independently actuable to enable control of the attitude of said center hull.

9. The variable-draft vessel of claim 6 wherein said element received by said non-metallic bearing is said guide rod.

10. The variable-draft vessel of claim 6 wherein when said rod is fully extended from said cylinder, said center hull and said side hull are at a maximum vertical distance relative to each other.

11. The variable-draft vessel of claim 6 wherein when said rod is fully retracted within said cylinder, said center hull and said two side hulls are at a minimum vertical distance relative to each other.

* * * * *